343-756 SR
12/27/77 XR 4,065,772

United States Patent [19]
Seavey
[11] 4,065,772
[45] Dec. 27, 1977

[54] BROADBEAM RADIATION OF CIRCULARLY POLARIZED ENERGY

[75] Inventor: John M. Seavey, Cohasset, Mass.

[73] Assignee: Adams-Russell Co., Inc., Waltham, Mass.

[21] Appl. No.: 702,750

[22] Filed: July 6, 1976

[51] Int. Cl.[2] ..... H01Q 13/00; H01Q 19/00

[52] U.S. Cl. ..... 343/786; 343/756; 343/783

[58] Field of Search ..... 343/756, 772, 783, 786; 343/786

[56] References Cited

U.S. PATENT DOCUMENTS

| | | | |
|---|---|---|---|
| 2,611,087 | 9/1952 | Alford | 343/756 |
| 3,031,661 | 4/1962 | Moeller et al. | 343/756 |
| 3,046,550 | 7/1962 | Bartholoma et al. | 343/756 |
| 3,569,974 | 3/1971 | McLeod | 343/756 |

FOREIGN PATENT DOCUMENTS

| | | | |
|---|---|---|---|
| 574,940 | 4/1959 | Canada | 343/772 |
| 715,957 | 9/1954 | United Kingdom | 343/783 |

*Primary Examiner*—Alfred E. Smith
*Assistant Examiner*—Harry Barlow
*Attorney, Agent, or Firm*—Charles Hieken

[57] ABSTRACT

A horn for radiating circularly polarized energy includes a rear launcher section commencing with a double-ridged cross section and ending at the horn flare with a square cross section with the plane of polarization so that the wave excited in the square cross section is along a diagonal of the square. The horn flare section opens up to a dimension of approximately 70% larger than the square throat dimension to narrow the elevation beam. A dielectric slab oriented in the horizontal plane is seated in the flare section for introducing a frequency-varying differential phase shift between orthogonal modes for effectively compensating for the inherent phase shift in the flare. Refracting lenses that are half-cylinders having a diameter of about 25% of the horizontal aperture dimension with their axes aligned vertically are located close to the vertical aperture edges for refracting the energy at the horn edges into the region between 30° and 60° from the horn axis.

13 Claims, 4 Drawing Figures

BROADBEAM RADIATION OF CIRCULARLY POLARIZED ENERGY

BACKGROUND OF THE INVENTION

The present invention relates in general to radiating elliptically polarized energy and more particularly concerns novel apparatus and techniques for radiating circularly polarized energy at relatively high power levels over a relatively broad frequency range from a horn with controlled directivity and a relatively high degree of circularity over the frequency range. A horn according to the invention is relatively compact, relatively easy to fabricate and provides good electrical and mechanical performance with relatively little maintenance.

Maintaining good circularity for highly asymmetrical beamwidth horns has been difficult. Among the prior art approaches are using arrays of horns, sectoral horns with meanderline transmission-type polarizers, constricted-aperture horns filled with dielectric to prevent cutoff and various rod-like parasitic devices to broaden the beam width in the aximuth plane.

The prior art approaches have a number of disadvantages. Those using parasitic devices have a tendency to work only over a relatively narrow frequency range. These using meanderlines have been inherently limited to relatively low power levels. Sectoral horns and arrays have been of large physical size. Those with constricted apertures present problems of maintaining impedance match, and those with dielectrics in the constricted apertures are relatively heavy.

Accordingly, it is an important object of this invention to provide an improved radiator of circularly polarized energy over a relatively broad range of frequencies that overcomes one or more of the disadvantages enumerated above.

It is a further object of the invention to achieve the preceding object over at least an octave.

It is a further object of the invention to achieve one or more of the preceding objects while radiating relatively high power levels.

It is still a further object of the invention to achieve one or more of the preceding objects with relatively compact structure that is relatively lightweight.

It is a further object of the invention to achieve one or more of the preceding objects while maintaining a desired impedance match with relative ease.

SUMMARY OF THE INVENTION

According to the invention, there is flared horn means for exchanging linearly polarized energy at its input end with elliptically polarized energy at its output end. The flared horn means preferably includes dielectric card means in a plane generally parallel to the short edges of the rectangular mouth of the horn for furnishing a frequency-varying differential phase shift to substantially compensate for the inherent phase shift in the flare of the horn means. Preferably, there is dielectric lens means adjcent each long edge of the horn mouth for refracting radiant energy near these edges toward the axis of the horn. Preferably, these lenses are semicylindrical and of diameter corresponding to about 25% the length of said short edge.

Numerous other features, objects and advantages of the invention will become apparent from the following specifiation when read in connection with the accompanying drawing in which:

DETAILED DESCRIPTION OF PREFERRED EMBODIMENTS

Figure 1:
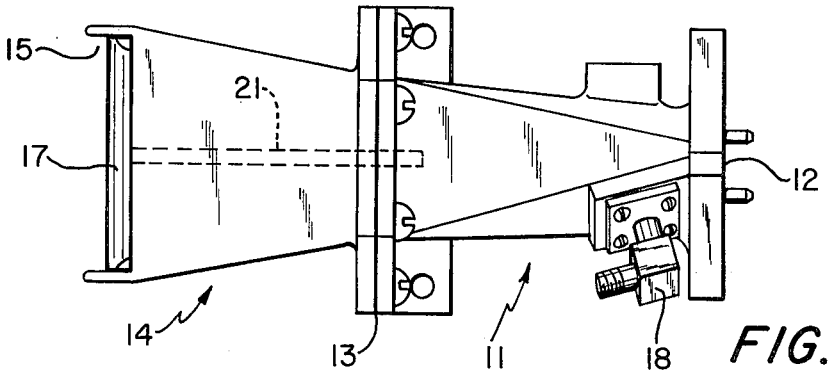
FIGS. 1–4 are elevation, plan, front and rear views, respectiely, of an embodiment of the invention.
Figure 2:
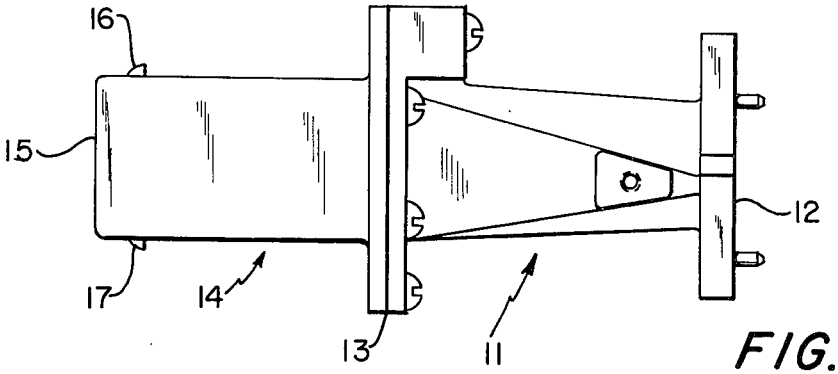

With reference now to the drawing, FIGS. 1–4 are elevation, plan, front and rear views, respectively, of an exemplary embodiment of the invention. The invention includes a rear launcher section 11 that exchanges linearly polarized energy at its input end 12 with linearly polarized energy at its output end 13 coupled to flared horn 14 having a square cross section input adjacent to output 13 that tapers in the vertical direction to the horn mouth or aperture 15. Horn mouth 15 carries a pair of semicylindrical dielectric microwave lenses 16 and 17 close to the vertical edges of the horn mouth 15 and of diameter about 25% the width of the horn mouth.

Figure 4:
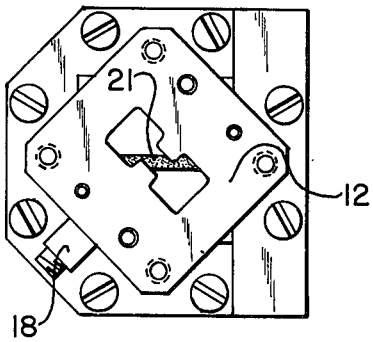

The input end 12 of the rear launcher typically comprises double-ridged waveguide as best seen in FIG. 4. The plane of polarization is chosen so that the wave excited in the square cross section at the output 13 is along a diagonal of the square cross section. A sampling probe 18 may be located near the input end 12 as shown.

A dielectric slab or card 21 that may be made of material such as G7 silicone fiberglass having a dielectric constant of 4.2 and dissipation factor of 0.003 in horn 14 and extending back into the rear launching section 11 in a plane perpendicular to the parallel normally vertical walls of horn 14 introduces a frequency-varying differential phase shift between the orthogonal components of the wave to effectively compensate for the differential phase shift introduced by the flare. For card 21 being perfectly matched at both ends an ellipticity ratio on axis of about 1.5 db may be attained. In practice where the impedance match is not perfect still ellipticity ratios of 2.5 db have been attained over a better-than-octave bandwidth. It has been found useful to start the dielectric card in rear launching section 11 as shown for obtaining a longer and better-matched card and also for the purpose of slightly increasing the "phase dispersion" introduced by the card, a frequency sensitive characteristic.

Having described the physical arrangement of the invention, the principles of operation will be described. The flared horn section 14 is a simple one-plane flare with parallel broad walls typically having a height at the mouth in the elevation plane about 70% larger than a side of the square throat to narrow the elevation beam width.

If the length of the flared horn section 14 is about equal to the height at the mouth of the horn, the energy radiated at the horn mouth is inherently perfectly circularly polarized at a frequency near the low end of the operating frequency band, the exact frequency being dependent upon the detailed proportions of the flare. As the frequency increases the phase of the vertical component at the mouth leads the horizontal component by an amount that progressively decreases and approaches zero at infinite frequency. The dielectric card 21 furnishes a delay to the horizontal component that introduces a frequency-varying differential phase shift so that a high degree of circularity is attained at the mouth. The introduction of the dielectric card is accomplished without increasing the length, width or volume of the assembly and negligibly increasing the weight. It has been discovered that by introducing the dielectric lenses 16 and 17, the azimuth beamwidth is greatly increased while maintaining and actually improving the degree of circularity over the entire pattern coverage region.

Figure 3:
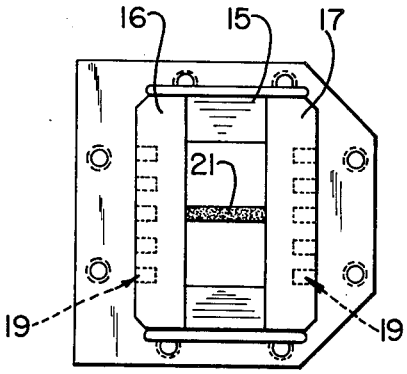

The basic asymmetrical aperture of the horn mouth of 1.7:1 physical asymmetry has radiation patterns which are approximately 120° in azimuth by 45° in elevation at the low end of the octave band, and this patern changes in a linear fashion with frequency so that at the upper end of the octave band the beamwidths are roughly 60° by 22.5°. The narrower coverage at the upper end may well be unacceptable for applications seeking wider coverage. The refracting microwave lenses 16 and 17 overcome this problem and have been discovered to function best when they are placed close to the vertical aperture long normally vertical edges and aligned normally vertically as best seen in FIG. 3. The shape of these lenses has been found to be not overly critical, and a half-cylinder with the diameter of each half-cylinder about 25% of the short normally horizontal aperture dimension found to be satisfactory.

It may also be advantageous to include a set of five shallow fins 19 aligned longitudinally on each of the vertical walls of the flare section in accordance with well-known techniques for more sharply tapering the amplitude distribution for the horizontally polarized component of the field at the mouth and thereby broaden the beamwidth for this polarization while improving the off-axis circularity.

Lenses 16 and 17 function to refract the energy at the horn edges into the angular region between 30° and 60° from the horn axis. Furthermore, it has been discovered that the refraction is polarization-insensitive.

It is preferred that the lenses not extend excessively beyond the horizontal envelope of the basic horn portion and be made of a dielectric material having a moderate dielectric constant. Too low a value will not provide adequate refraction while too high a value may result in front surface reflections from the lens that tend to propagate back into the horn throat where they arrive orthogonally polarized to the launched wave and may be reflected and emerge from the aperture as an oppositely-sensed circularly polarized wave to rapidly deteriorate the resultant circularity. A preferred value of dielectric constant is 3.0 and characterizes Stycast HIK3 manufactured by either 3M or Emerson and Cummings and has a dissipation factor of about 0.001.

The positioning of the half-cylinder lenses 16 and 17 has been found to be somewhat critical with the lateral displacement being the controlled dimension. It has been found that for best performance the outboard edge of the lenses 16 and 17 are slightly outside the wall of the horn mouth as best seen in FIG. 1, by an amount typically corresponding substantially to the radius of the semicylindrical lenses.

The preferred positioning described above is for maximizing compactness. For example, it has been discovered that by allowing the lenses to protrude about 50% of the aperture width beyond the horn aperture and reshaping them into elliptical shapes, much wider azimuth beamwidths are attainable. Conventional geometrical optics array tracing techniques may be used for designing the lenses. Thus, the invention may be used to provide horns characterized by a wide range of azimuth beamwidths.

Specific embodiments of the invention using lenses, fins and dielectric cards have essentially constant azimuth and elevation beamwidths over an octave frequency band with relatively good circularity, a typical value for the ellipticity ratio being a maximum of 5 decibels over the solid illumination angle and 3 db maximum on axis. For a specific embodiment a typical frequency band is over an octave plus 10% with a maximum VSWR of 1.6 and a power handling capability of 1000 watts continuous wave. A typical weight for an assembly operative over the frequency range from 4.65 to 9.85 GHz is but 0.7 pounds.

There has been described novel apparatus and techniques for illuminating a prescribed solid angle at relatively high power levels with circularly polarized energy of relatively good circularity relatively efficiently with a compact structure of relatively light weight. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Apparatus for radiating elliptically polarized energy over a relatively broad frequency range comprising, rear launching means having an input port and a square output port for exchanging polarized radiant energy at the input port with radiant energy polarized along a diagonal of the square portion at the output port, flared horn means having parallel broad walls and a square input port connected to the rear launching means output port and a rectangular output aperture for exchangng linearly polarized energy polarized along said diagonal with elliptically polarized energy at said output aperture, and a dielectric card in said flared horn portion perpendicular to the parallel broad walls of said horn portion for furnishing a frequency-varying differential phase shift between orthogonal components of wave energy inside said flared portion coacting therewith to substantially compensate for the inherent phase shift in the flare of said horn means for reducing the ellipticity ratio at said output aperture.

2. Apparatus for radiating elliptically polarized energy in accordance with claim 1 and further comprising, dielectric lens means adjacent each edge of said output aperture at the parallel broad walls for increasing the azimuth beamwidth in a plane perpendicular to said broad walls without increasing said ellipticity ratio over the solid angle of the radiation pattern of said apparatus.

3. Apparatus for radiating elliptical energy in accordance with claim 2 and further comprising shallow fins aligned longitudinally on said parallel broad walls inside said flare section for more sharply tapering the amplitude distribution of the component of said radiant energy polarized in a direction perpendicular to said parallel broad walls.

4. Apparatus for radiating elliptical energy in accordance with claim 2 wherein said lense means comprise, dielectric material in the form of a cylinder having its axis parallel to the plane of said parallel broad walls.

5. Apparatus for radiating eliptically polarized energy in accordance with claim 4 wherein said lens are semicylindrical of diameter substantially one quarter the separation between said parallel broad walls.

6. Apparatus for radiating elliptically polarized energy in accordance with claim 4 wherein said lenses are portions of elliptical cylinders.

7. Apparatus for radiating elliptically polarized energy in accordance with claim 1 wherein the length of said flared horn means is substantially equal to the length of said output aperture and a portion of said dielectric card extends into said rear launching means.

8. Apparatus for radiating elliptically polarized energy in accordance with claim 7 wherein the dielectric constant of said dielectric card is of the order of 4.2.

9. Apparatus for radiating elliptically polarized energy in accordance with claim 7 and further comprising, dielectric lens means adjacent to each end of said output aperture at the parallel broad walls for increasing the azimuth beamwidth in a plane perpendicular to said broad walls without increasing said ellipticity ratio over the solid angle of the radiation pattern of said apparatus.

10. Apparatus for radiating elliptically polarized energy in accordance with claim 9 wherein said lens means comprise semicylindrical lenses of diameter substantially $\frac{1}{4}$ the separation between said parallel broad walls.

11. Apparatus for radiating elliptically polarized energy in accordance with claim 10 wherein the dielectric constant of said dielectric lenses is of the order of 3.

12. Apparatus for radiating elliptically polarized energy in accordance with claim 11 wherein the output edge of each lens is slightly outside said output aperture.

13. Apparatus for radiating elliptically polarized energy in accordance with claim 12 and further comprising shallow fins aligned longitudinally on said parallel broad walls inside said flared section for more sharply tapering the amplitude distribution of the component of said radiant energy polarized in a direction perpendicular to said parallel broad walls.

* * * * *